US006196757B1

(12) United States Patent
Bakke

(10) Patent No.: US 6,196,757 B1
(45) Date of Patent: Mar. 6, 2001

(54) ANCHORING MECHANISM FOR A GUIDE POST

(75) Inventor: Paal Bakke, Kongsberg (NO)

(73) Assignee: Kongsberg Offshore AS, Kongsberg (NO)

( * ) Notice: Subject to any disclaimer, the term of this patent is extended or adjusted under 35 U.S.C. 154(b) by 0 days.

(21) Appl. No.: 09/207,798

(22) Filed: Dec. 9, 1998

(30) Foreign Application Priority Data

Dec. 9, 1997 (NO) ..... 975782

(51) Int. Cl.[7] ..... F16L 1/00
(52) U.S. Cl. ..... 403/328; 403/322.3; 405/169
(58) Field of Search ..... 166/341, 343; 403/322.3, 322.1, 321, 328; 294/86.17, 86.2, 86.24; 405/169

(56) References Cited

U.S. PATENT DOCUMENTS 3,019,840 * 2/1962 Kennard ..... 294/86.24
4,004,635 * 1/1977 Marquaire et al. ..... 166/343 X
4,418,770 * 12/1983 Lambot ..... 294/86.24 X
4,439,068 * 3/1984 Pokladnik ..... 405/169
4,611,953 * 9/1986 Owens ..... 405/169 X
4,676,696 * 6/1987 Laursen ..... 405/169
4,717,287 * 1/1988 Laursen ..... 166/341 X
4,828,035 5/1989 McInturff .
4,877,356 * 10/1989 Bontenbgl ..... 166/341 X
5,318,384 * 6/1994 Malobertie et al. ..... 166/341 X
5,480,251 * 1/1996 Pavageau et al. ..... 403/322.1 X
6,003,873 * 12/1999 Solberg ..... 405/169 X

FOREIGN PATENT DOCUMENTS 2 225 789 6/1990 (GB) .

* cited by examiner

*Primary Examiner*—Lynne H. Browne
*Assistant Examiner*—John Cottingham
(74) *Attorney, Agent, or Firm*—Kenyon & Kenyon

(57) ABSTRACT

The anchoring mechanism comprises a guide post lock formed in the shape of a sleeve. The sleeve is movable inside a guide post and can lock the guide post to a funnel of a seabed frame by means of lower lockpins passing through radial bores in the guide post. The guide post lock can be raised by an anchor lock for a wire. Raising the anchor lock enables the lockpins to be moved radially inwards. The anchor lock is also able to raise the guide post by upper lockpins in axial slots in the guide post lock passing through upper, radial bores in the guide post. The lower lockpins are pressed inwardly by means of the lower beveled edge of the funnel.

8 Claims, 1 Drawing Sheet

ANCHORING MECHANISM FOR A GUIDE POST

FIELD OF THE INVENTION

The present invention relates to an anchoring mechanism for a guide post maintained in a seabed frame.

BACKGROUND OF THE INVENTION

Guide posts are often used on seabed frames. Normally, four 203 mm (8") posts are inserted in the frame at certain intervals. From the top of the posts a wire is run to the surface. The wires are kept tensioned. By means of the wires equipment can be lowered to the seabed frames and guide the equipment in position within given tolerances. The posts can be permanent or replaceable. There are two reasons for choosing a removable guide post. One reason is the costs in connection with making all the posts which are needed permanently down on the frame. The second reason is that they may block access for other equipment. The posts can be several meters long, for example, 3 to 4 meters. By making them replaceable, a much smaller number of posts is needed.

Prior art replaceable guide posts have relatively complicated and costly mechanisms.

A standard retrievable guide post has lockpins that are activated via a permanently installed wire within the post.

The patent GB A 2,225,798 discloses a replaceable guide post 17 which is lowered into a funnel 10 and temporarily locked by a lockpin 34. By lifting the guide post 17 upwards the sleeve 37 and the member 18 are slid upwards and the locking ring 40 and the lockpin 43 are moved upwards and lock the guide post 17 to the funnel 10.

The patent U.S. Pat. No. 4,828,035 discloses replaceable guide post A which is locked into the funnel 400 by means of a snap ring 120.

The object of this invention is to provide an anchoring mechanism of a simpler construction and thus at considerably lower manufacturing costs.

SUMMARY OF THE INVENTION

In accordance with this object, the guide post has an annular ridge which abuts against a funnel on the seabed frame. An anchor lock is provided, and the anchor lock has radially movable upper and lower dogs. A guide post lock is shaped like a sleeve. In the upper part of the guide post lock, the diameter of the sleeve is at its largest. The diameter corresponds to the inner diameter of the guide post so that the lock may move within the guide post. In this upper region, the guide post has axial slots. In the lower part of the guide post lock, the lock has a smaller diameter. The smaller diameter is chosen so that the anchor lock may move within the guide post lock. The outside diameter of the guide post lock is stepped down from the upper portion to the lower portion. An annular groove is located on the inside surface of the guide post lock, and is placed so that it intersects a lower end of the axial slots. Lower lockpins with radial flanges are located in radial bores in the guide post lock. Upper lockpins are located in the axial slots, and have a flange. The flange is sized so that it cannot pass through the slots, but can pass into the annular groove.

DETAILED DESCRIPTION OF THE DRAWINGS

Figure 1:
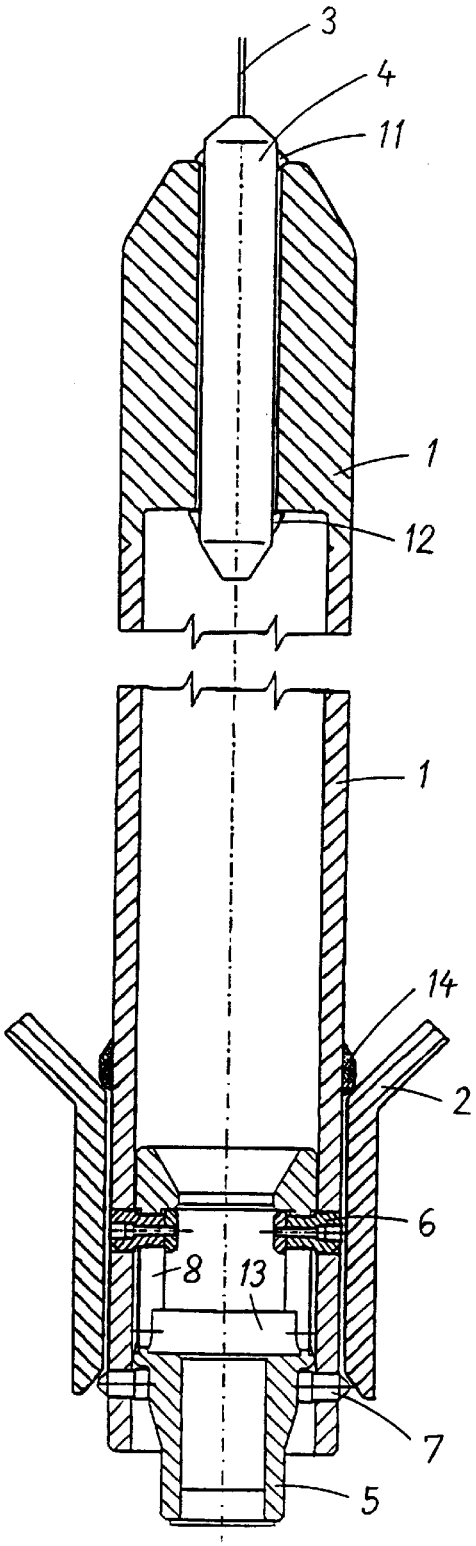
FIG. 1 is a sectional view in the longitudinal direction of a guide post anchored with the guide post lock to a funnel fastened to the seabed frame.
Figure 3:
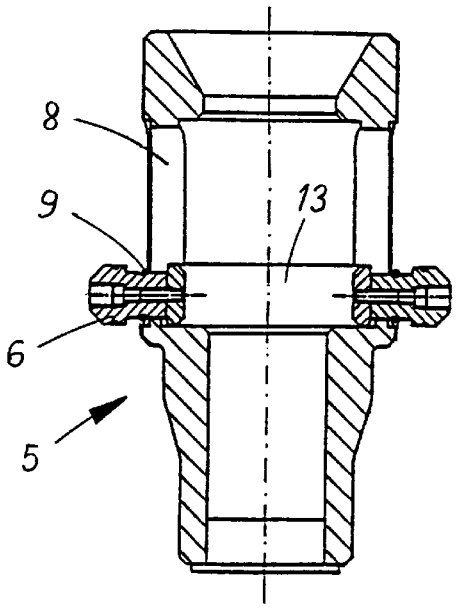
FIG. 3 is a sectional view in the longitudinal direction of the guide post lock in a larger scale.

FIG. 1 shows a guide post 1 in a normal operational position. The guide post 1 is anchored in a seabed frame by a few lower lockpins 7. The lower lockpins 7 extend radially out underneath a funnel 2 fastened in a seabed frame. The lower lockpins 7 have flanges on the inside of the guide post 1 . The guide post 1 is locked at the bottom against upward movement in the funnel 2 by a guide post lock 5 and the lockpins 7. The guide post 1 is prevented from sliding downwards in the funnel 2 by an annular ridge 14 fastened to the guide post 1.

During preparation at the surface for installation in the funnel 2, the guide post lock 5 is mounted by raising the guide post lock somewhat within the guide post 1 and then pushing the upper lockpins 6 radially outwards so that they are engaged in an inside annular groove 13 in the guide post lock 5. The guide post lock 5 will thus be prevented from sliding downwards. The upper lockpins 6 are further prevented from sliding radially inwards by means of an O-ring 9 abutting the sides of the axial slots 8 for the lockpins 6 in the guide post lock 5.

When the guide post 1 together with the guide post lock 5 by means of the wire 3 and the anchor lock 4 are let down into the funnel 2 which is locked to the frame, the funnel 2 will cause the upper lockpins 6 to move radially inwards (due to gravity) until they are not locked in the annular groove 13. This means that the guide post lock 5 can slide further down in the guide post 1 and then press the lower lockpins 7 radially outwards. Initially, the upper lockpins 6 will slide inwards, then the guide post lock 5 will slide downwards in the guide post 1 a distance, so that the upper lockpins 6 are unable to move outwards again. The lower lockpins 7 will then be subjected to a radial load due to the mass of the guide post lock. However, the lower lockpins 7 will only slide to the outer position after they have arrived below the lower edge of the funnel 2. Then the guide post lock 5 will slide down to such an extent that the lower lockpins 7 will lock against the part of the guide post lock 5 having the larger diameter. The lower lockpins 7 are now able to take the load with which the wire is pulled.

Figure 2:
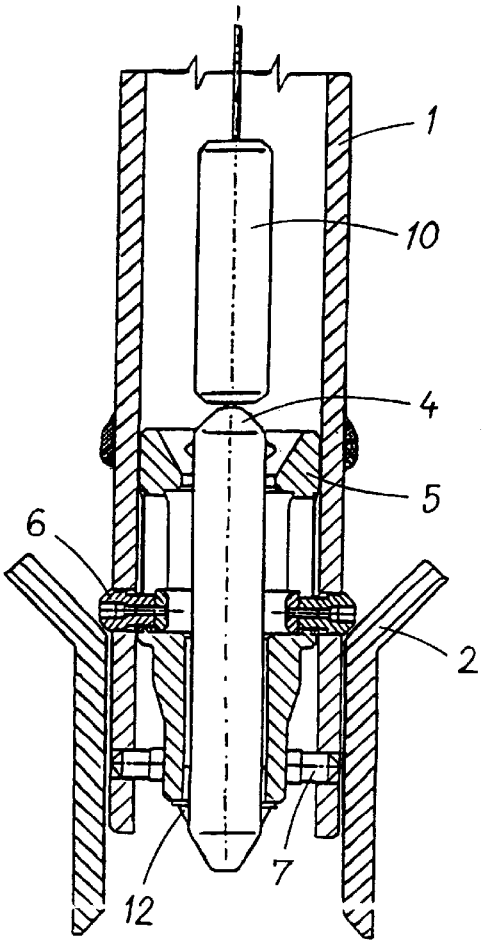
FIG. 2 is a sectional view like FIG. 1 showing a situation when the guide post and the guide post lock are retrieved from the funnel.

When it is desired to retrieve the guide post 1, a weight 10 is dropped down the wire 3 (FIG. 2). The weight 10 beats the anchor lock 4 downwards because the upper dogs 11 on the top of the anchor lock 4 have beveled edges and can move resiliently inwards. The anchor lock 4 is guided downwards and into the guide post lock 5. At the lower end of the anchor lock 4, there are several dogs 12 which can move resiliently inwards because of their beveled lower edges. The dogs 12 allow the anchor lock 4 to be guided down to its appropriate position with the lower dogs 12 underneath the guide post lock 5. The lower dogs 12 will then move rapidly outwards. The upper, radially extending edges of the lower dogs 12 lock the anchor lock 4 to the guide post lock 5. By pulling the guide post lock 5 via the anchor lock 4 and the wire 3, the lower lockpins 7 can move radially inwards. The guide post 1 is now released and can be retrieved to the surface.

What is claimed is:

1. Anchoring mechanism for a guide post (1), comprising an anchor lock (4) with radially movable upper and lower dogs (11, 12) for a wire (3) from the surface, the guide post (1) having an annular ridge (14) for the abutment against a funnel (2) which is fastened to a seabed frame, and the anchor lock (4) having a weight (10) for the anchor lock, characterized in that the anchoring mechanism is comprising a guide post lock (5) with the form of a sleeve with its largest outside diameter in the upper part corresponding to the inner diameter of the guide post (1) for movement inside the guide post, the guide post lock (5) having a smaller inside diameter in the lower part corresponding to the outside diameter of the anchor lock (4) for accommodating the anchor lock (4) inside the guide post lock (5), the outside diameter of the guide post lock (5) in its lower part is stepped down in steps having a conical area between the steps for guiding of radial movements of lower lockpins (7) provided in lower radial bores in the guide post (1) adjacent its lower end, and the lockpins (7) having flanges on the inside of the guide post (1), the guide post lock (5) in its upper part with the largest outside diameter having axial slots (8) and the guide post lock (5) having at the lower edge of the slots an inside annular groove (13) crossing the slots (8) in the lower part, the slots (8) are provided with upper lockpins (6) each having a stem diameter corresponding to the width of the slots (8) and with a flange inside the guide post lock (5) against the inside of the slots (8), in that the width of the annular groove (13) is a little larger than the flange diameter of the upper lockpins (6) and the upper lockpins (6) capable of passing through upper radial bores in the guide post (1) when the guide post lock (5) is mounted inside the guide post (1).

2. Anchoring mechanism according to claim 1, characterized in that the upper lockpins (6) having O-rings (9) against the walls of the axial slots (8).

3. Anchoring mechanism according to claim 1–2, characterized in that the flanges of the upper lockpins (6) inside the guide post lock (5) are formed by washers fastened to the end of the upper lockpins (6).

4. Anchoring mechanism according to claim 3, characterized in that the part of the upper lockpins (6) which is passing through the upper radial bores in the guide post (1) having a larger diameter than the stem diameter.

5. An anchoring mechanism for a guide post, the guide post having an annular ridge for abutment against a funnel which is fastened to a seabed frame, the guide post having upper and lower radial bores, the anchoring mechanism comprising:

an anchor lock for a wire, the anchor lock having radially movable upper and lower dogs;

a guide post lock with a form of a sleeve, wherein the guide post lock has its largest outside diameter in an upper part, and the largest diameter corresponds to an inner diameter of the guide post so that the guide post lock may move inside the guide post, wherein the guide post lock has a smaller inside diameter in a lower part, and the smaller inside diameter corresponds to an outside diameter of the anchor lock so that the anchor lock can be placed inside the guide post lock, wherein the outside diameter of the guide post lock in the lower part is stepped down in steps and a conical area is located between the steps, wherein the guide post lock has axial slots located in the upper part with the largest outside diameter, and wherein the guide post lock has an annular groove on an inside surface of the guide post lock, and the annular groove crosses a lower edge of the axial slots;

lower lockpins located in the lower radial bores in the guidepost, the lower lockpins having flanges which are capable of being located on the inside of the guide post lock, the lower lockpins being guided by the steps and conical areas of the guide post lock; and upper lockpins located in the axial slots in the guide post lock, each upper lockpin having a stem diameter corresponding to a width of the axial slots and having a flange inside the guide post lock against the inside of the slots, wherein the width of the annular groove is a little larger than the flange diameter of the upper lockpins and the upper lockpins capable of passing through the upper radial bores in the guide post when the guide post lock is mounted inside the guide post.

6. The anchoring mechanism according to claim 1, wherein the upper lockpins have O-rings against the walls of the axial slots.

7. The anchoring mechanism according to claim 6, wherein the flanges of the upper lockpins inside the guide post lock are formed by washers fastened to the end of the upper lockpins.

8. The anchoring mechanism according to claim 7, wherein the part of the upper lockpins which is passing through the upper radial bores in the guide post has a larger diameter than the stem diameter.

* * * * *